US005275439A

United States Patent [19]

Hawes, Jr. et al.

[11] Patent Number: 5,275,439

[45] Date of Patent: Jan. 4, 1994

[54] HANGING LAMINATED FOLDER

[75] Inventors: Robert E. Hawes, Jr., Huntington Bay; Cheryl Dellacroce-Steinberg, Jericho; Eric Aaldenberg, Bayside, all of N.Y.; James J. Lynch, Berkley Heights, N.J.

[73] Assignee: Esselte Pendaflex Corporation, Garden City, N.Y.

[21] Appl. No.: 867,863

[22] Filed: Apr. 10, 1992

Related U.S. Application Data

[63] Continuation-in-part of Ser. No. 769,001, Sep. 30, 1991, Pat. No. 5,261,636, which is a continuation of Ser. No. 483,094, Feb. 21, 1990, Pat. No. 5,066,045.

[51] Int. Cl.[5] ..... B42F 15/00

[52] U.S. Cl. ..... 281/45; 40/359; 229/68 R

[58] Field of Search ..... 40/359; 229/68R; 281/45 281/51; 493/89, 947

[56] References Cited

U.S. PATENT DOCUMENTS

| | | | |
|---|---|---|---|
| 2,291,724 | 8/1942 | Jonas | 129/16.7 |
| 3,779,393 | 12/1973 | Grundell | 211/126 |
| 3,933,294 | 1/1976 | Meenan et al. | 229/1.5 R |
| 4,031,646 | 6/1977 | de Nouel | 40/359 |
| 4,053,057 | 10/1977 | Snowden | 211/126 |
| 4,284,227 | 8/1981 | Corey | 229/1.5 R |
| 4,523,776 | 6/1985 | Barber | 283/39 |
| 4,580,815 | 4/1986 | Barber | 283/81 |
| 4,749,121 | 6/1988 | Barber | 229/1.5 R |
| 4,806,397 | 2/1989 | Horwitz | 428/14 |
| 4,830,268 | 5/1989 | Pitts | 229/68 R |

FOREIGN PATENT DOCUMENTS

| | | |
|---|---|---|
| 563159 | 12/1957 | Belgium . |
| 630978 | 11/1963 | Belgium . |
| 1236472 | 3/1967 | Fed. Rep. of Germany . |
| 1463195 | 11/1966 | France . |
| WO90/03890 | 4/1990 | PCT Int'l Appl. . |

*Primary Examiner*—Paul A. Bell
*Attorney, Agent, or Firm*—Pennie & Edmonds

[57] ABSTRACT

A folder that hangs on a standard frame in office storage equipment which includes a sheet of flexible material folded at a medial line to form a bottom edge with an exterior surface and front and rear portions joined at the bottom edge, each of front and rear portions having an interior surface and an exterior surface, wherein the ends of said front and rear portions removed from said bottom edge are folded over to form top terminal folded portions, a reinforcing layer comprising one or more strips of plastic material laminated onto the folder and applied to substantially all of the exterior surfaces to increase the wear resistance, strength and life of said folder, and means for hanging the folder on the frame.

17 Claims, 1 Drawing Sheet

HANGING LAMINATED FOLDER

RELATED APPLICATIONS

This application is a continuation-in-part of U.S. application Ser. No 07/769,001, filed Sep. 30, 1991, now U.S. Pat. No. 5,261,636, Nov. 16, 1993, which is a continuation of application Ser. No. 07/483,094, filed Feb. 21, 1990, now U.S. Pat. No. 5,066,045.

TECHNICAL FIELD

The present invention relates to paper office supplies and, in particular, to hanging folders having laminated portions for increased strength, longer life and paper surface integrity.

BACKGROUND ART

Paper hanging folders, for use in standard storage units such as file cabinets, desk drawers and o the like, are a necessary tool in modern offices and businesses. Such folders in the art are best exemplified by expired U.S. Pat. No. 2,291,724, which was assigned to the assignee of the present application. This reference describes a file formed by a sheet of heavy material with a central horizontal fold which forms the folder's bottom and open sides. Folds are provided in the file's top edges through which hanging rods are movably or immovably fixed. The ends of these rods are exposed and notched, enabling the file to hang on a complementary standard parallel file frame in office storage equipment, such as filing cabinets and desk drawers.

The inner surfaces at the tops of the folded-over portions contain uniformly spaced slots for insertions of labeling tabs. These slots often tear or wear out as new tabs are inserted or removed, due to the need for frequent file relabeling or repositioning of labels in alternative slots of the file. Also, when the user inserts the tabs of the label into the slots, close attention is required because the opening of the slot and the material behind it are generally identical in color. Due to the wear and tear on tab slots, files are often replaced simply because the tab slots are torn or worn out, rendering the file useless. Also, handling during normal use and tab changing causes additional wear on the top of the file due to the release of body oils and friction between the paper and fingers. This type of wear is not diminished by the rods disposed through the file's top folds, because finger oils and friction break down the material of the file, which is generally paper, regardless of the underlying support of the rod.

U.S. Pat. No. 4,749,121 discloses a hanging folder with a reinforcing plastic film applied to the o side edges to reduce wear on the side of the file as it is moved in the frame. This film may be applied with colored adhesive to provide a color coding system or a clear film may be applied over a colored surface by a clear adhesive to achieve the same result. Similar side reinforcing techniques are disclosed in U.S. Pat. Nos. 4,523,776 and 4,580,815.

When hanging files are filled with a large volume of paper, the sides tend to spread away from each other and the bottom lifts. However, the present inventors have learned that when the file holds a narrow heavy object, the bottom of the file drags along the bottom of the drawer or other container for the frame, leading to wear and tear on the bottom of the file. This necessitates file replacement before the body of the file has worn out.

It is clear that a need exists for a hanging folder file which has a strong bottom to hold the weight of its contents and to guard against wear due to its being dragged along the bottom of a drawer. Also, a reinforced top edge is needed to guard against wear from handling and the insertion of tabs. A need further exists for a folder which makes tab insertion easy and faster than folders of the prior art now allow.

SUMMARY OF THE PRESENT INVENTION

The present invention is directed to hanging folders formed by folding a sheet of heavy duty paper along one or more medial lines which form the bottom of the folder. The entire exterior surface of the folder is covered with a reinforcing layer. The layer may extend over the top of the front and rear surfaces of the folder and down to the lower edge of the folded over portion. The layer may be formed of a single piece of reinforcing material, a plurality of reinforcing strips, by lamination, extrusion, or coating with a polymer or resin liquid or solution which is subsequently cured.

The top edges of the paper are folded over and glued down to the inside of the file and provide openings for hanging rods from which the folder is suspended on a standard file frame in office storage equipment. The inner surfaces of the top folds have slots for insertion of labelling tabs. If the outside and inside surface of the sheet are of different colors, the inside of the front and rear faces below the folded down portion will be of a contrasting color to the rest of the file. This color contrast is visible through the tab slots. As noted above, the reinforcement extends over the folded top edges and around the slots primarily to improve the wear resistance of this portion of the folder.

Folders formed according to the present invention provide at least six advantages to the user. First, the bottom of the folder is laminated to prevent tearing and wear from the weight of the file's contents, such as by scraping of the file along the bottom of a drawer. Second, the outer and inner top edges of the file, except the tab slots, are also covered with a laminate to decrease wear and tear from normal handling and tab insertion. Third, the reinforcement around the slots provides advantages with regard to the ease of insertion of the tab ends into the slots. Fourth, the color contrast between the area surrounding the tab slots and the area behind the slots enables quick and easy visual location of the slots for insertion of tabs, thus leading to less effort on the part of the user and less wear and tear on the tabs and slots. Fifth, the entire outer portions of the folder are protected from moisture or wear by the reinforcement. Sixth, this entire outer reinforcement allows less expensive pigmentation or colorants to be utilized on the paper substrate. All of these advantages add to the durability of the file and prolongs its usefulness.

BRIEF DESCRIPTION OF THE DRAWINGS

The foregoing and other features of the present invention will be more readily apparent from the following detailed description and drawings of an illustrative embodiment of the invention in which.

DESCRIPTION OF THE PREFERRED EMBODIMENTS

Figure 1:
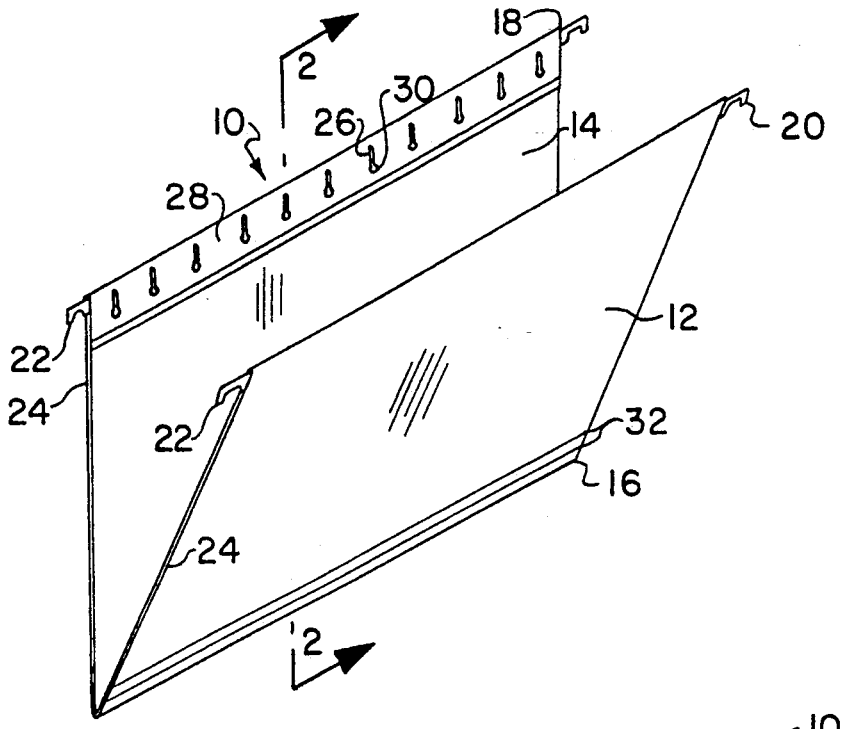
FIG. 1 shows a perspective view of a hanging folder having a reinforcing layer applied to the entire exterior surface thereof.
Figure 2:
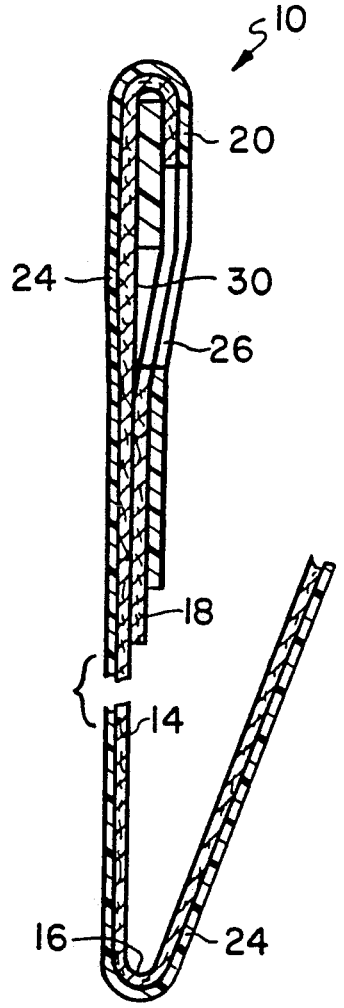
FIG. 2 shows a right side sectional view (partially broken) of the hanging folder of FIG. 1 along line 2—2.

FIG. 1 shows a hanging folder 10 having a front portion 12, and a rear portion 14 connected along one or more medial folds 16. At the upper edges of the front and rear portions there are terminal folds 18 which, on the inside of the file, define slots 26 for tabs and through which hanging rods 20 are disposed, as shown in FIG. 2. The end portions of the hanging rods 20 have notches 22 which are complementary to a standard filing frame in office storage equipment, thus enabling the file to hang while stored, e.g. in a file drawer.

The outer surface of the folder 110 is covered by a reinforcing layer 24 which is preferably laminated thereto. As best shown in FIG. 2, the reinforcing layer 24 covers the entire outer surface of the front and rear portions 12, 14 of the folder 10, including the medial fold 16, and extends over the terminal folds 18 located at the inside upper edges of the file. The shaped slots 26 formed in the terminal folds 18 are not covered by the lamination to facilitate insertion of labels or tabs thereinto.

This reinforcing layer 24, the placement of which is shown in detail in FIG. 2, protects against frequent handling of the file, and strengthens and protects the bottom of the file when it is subject to abrasion, such as when it is dragged along a file drawer bottom while carrying the weight of heavy stored papers or other items.

The reinforcing layer 24 may comprise a single piece or sheet of a reinforcing material, such as paper, cardboard or a plastic film of polyethylene, polypropylene, TYVEK, or the like. These materials are applied to the folder using a suitable adhesive, which is placed on the reinforcement or on the folder. Alternatively, a plurality of reinforcing strips of those materials or of fiber reinforced tape may be positioned adjacent one another to cover the entire exterior surface of the folder 10 in the manner described above to provide the full exterior reinforcement. Again, an adhesive is preferably utilized to secure these strips to the folder.

The present invention also contemplates the application of reinforcement by other techniques, such as by the lamination of the sheet or reinforcing material onto the paper using pressure. For this embodiment, the reinforcing material and paper may simply be passed between two rollers which supply the necessary pressure to adhere the materials to each other. It is also possible to apply the reinforcement as a liquid or solution of a polymer or resin which may be cured after application to the paper, if necessary. Other polymer or resin coatings may be used as reinforcement. Moreover, sheets of plastic reinforcement may be extruded directly onto the paper.

The reinforcing layer 24 serves to strengthen and protect the entire folder from wear associated with frequent handling. In addition, the reinforcing layer provides resistance to tear which can occur when full and/or heavy folders are moved within the file drawer. Further, the reinforcing layer protects the folder from liquids, such as coffee and water, which may be spilled onto the folder in an office environment when the folder is removed from the file drawer. Yet another advantage of the reinforcing material is that it allows the folder to be pigmented or colored more easily and inexpensively than prior folders, because the reinforcing material protects the pigmented or colored portions so that less expensive pigments, colorants, or dyes can be used. In addition, less expensive methods can be used for applying such pigments, colorants and dyes.

In a preferred embodiment, the color of the inner surfaces of the material from which the file is made differ from the color of the outer surfaces. As a result, the slotted portion of the laminated edge 28 contrasts with the color of the inside portion of the file 30 and is visible through the slots 26. This color contrast makes visual location of the slots and insertion of new tabs into the slots easier. Easier insertion results in less contact with the portion surrounding the slots 26, reduction in wear and prolonged usefulness life of the file 10. The lamination also makes it easier to punch the teardrop slots during manufacture of the folder.

Another advantage of the reinforcement of the slot portion of the folder is that a smooth material such as plastic allows the tab ends to be more easily slid and inserted into the slots compared to nonreinforced folders. The relatively low amount of force which is required to insert the tab ends into the slots is also due in part to the reinforcement causing the terminal folds 18 to tend to bow away from the hanging rods 20, so that the slots are maintained in an open position for receiving the ends of the tabs. This feature of the present invention provides an unexpected and substantial improvement compared to hanging folders which do not include reinforcement around the tab mounting slots.

The folder of the invention may have a multiplicity of horizontal depressions 32 on its bottom edges which can be folded by the user to create additional medial folds to expand or square off the bottom of the folder. These folds are used to expand the folder to receive larger amounts or quantities of paper. Previous non-reinforced folders were known to fail at these fold lines, with the paper tearing along the fold line during extended folding and unfolding. It was believed that the reinforcement would be advantageous in holding together the torn sections of paper as the folder deteriorates when used. However, it has been unexpectedly found that the application of reinforcement along these fold lines substantially increases the useful life of the folder, because the paper does not break or tear at the fold line as it does when it is not reinforced as described herein.

While the present invention has been particularly shown and described with reference to a preferred embodiment thereof, it will be understood by those skilled in the art that various changes in form and details may be made therein without departing from the spirit and scope of the invention.

What is claimed is:

1. A folder for hanging on a standard frame in office storage equipment comprising:

a sheet of flexible material folded at a medial line to form a bottom edge having an exterior surface and front and rear portions joined at said bottom edge, each of said front and rear portions having an interior surface and an exterior surface, wherein the ends of said front and rear portions remote to said bottom edge are folded to form top terminal folded portions;

uniformly spaced slots in at least one of the top terminal folded portions for receiving label tabs;

a reinforcing layer applied to substantially the entire exterior surfaces of said front portion, said rear portion, said terminal portions and said bottom edge, but not covering said slots;

means for hanging said folder on said frame; and wherein said reinforcing material comprises a plastic material which is laminated to said folder.

2. The hanging folder of claim 1, wherein the uniformly spaced slots are oriented transversely to said medial line.

3. The hanging folder of claim 1, wherein said means for hanging said folder on said frame includes two rods having notches complementary to said standard frame, said rods being disposed through said terminal folded portions on the top edges of said front and rear portions of said folder.

4. The hanging folder of claim 1, wherein said reinforcing layer comprises a single piece or sheet of plastic material.

5. The hanging folder of claim 1, wherein a substantial portion of said folder is pigmented or colored, and said portion is visible through said reinforcing layer covering said portion.

6. The hanging folder of claim 1, wherein said reinforcing layer comprises a plurality of adjacent strips of plastic material.

7. The hanging folder of claim 1 wherein said folder is formed from a material selected from the group consisting of colored paper, plastic or fiber.

8. The hanging folder of claim 1, further including at least one horizontal linear depression formed along the bottom edge to provide a crease line for forming at least one additional medial line to facilitate expansion of said folder.

9. The hanging folder of claim 1, wherein said reinforcing layer is a resin or polymer.

10. A folder for hanging on a standard frame in office storage equipment comprising:

a sheet of flexible material folded at a medial line to form a bottom edge with an exterior surface and front and rear portions joined at said bottom edge, each of said front and rear portions having an interior surface and an exterior surface, wherein the ends of said front and rear portions remote to said bottom edge are folded over to form top terminal folded portions;

uniformly spaced slots in each of the top terminal folded portions for receiving label tabs;

a reinforcing layer comprising at least one strip of plastic material laminated onto said folder and is applied to substantially all of said exterior surface of said front portion, said rear portion, said terminal portions, and said bottom edge, but not covering said slots to increase the wear resistance, strength and life of said folder; and means for hanging said folder on said frame including two rods having notches complementary to said standard frame, said rods disposed through said terminal folded portions on the top edges of said front and rear portions of said folder.

11. The hanging folder of claim 10, wherein the uniformly spaced slots are oriented transversely to said medial line.

12. The hanging folder of claim 10, wherein said folder is formed of one of colored paper, plastic, and fiber, and said reinforcing layer is one of paper, cardboard or a plastic.

13. The hanging folder of claim 10, further including at least one horizontal linear depression formed along the bottom edge of said folder to provide a crease line for forming at least one additional medial line to allow for expansion of the bottom of said folder.

14. A folder for hanging on a standard frame in office storage equipment comprising:

a sheet of flexible material folded at a medial line to form a bottom edge with an exterior surface and front and rear portions joined at said bottom edge, each of said front and rear portions having an interior surface and an exterior surface, wherein the ends of said front and rear portions removed from said bottom edge are folded over to form top terminal folded portions;

uniformly spaced slots in at least one of the top terminal folded portions;

a pigment of color which is applied to a portion of the exterior surface of the folder;

a reinforcing material which is applied to substantially all of said pigmented or colored exterior surfaces of said front portion, said rear portion, said terminal portions and said bottom edge, but not covering said slots, to protect the pigmented or colored areas and to increase the wear resistance, strength and life of said folder wherein said portion is visible through said reinforcing material;

means for hanging said folder on said frame including two rods having notches complementary to said standard frame, said rods disposed through said terminal folded portions on the top edges of said front and rear portions of said folder; and wherein said reinforcing material comprises a plastic material which is laminated to said folder.

15. The hanging folder of claim 14, wherein the uniformly spaced slots are orinted transversely to said medial line.

16. The hanging folder of claim 15 wherein said folder is formed from a material selected from the group consisting of colored paper, plastic or fiber.

17. The hanging folder of claim 14, further including at least one horizontal linear depression formed along the bottom edge to provide a crease line for forming at least one additional medial line to facilitate expansion of the bottom of said folder and wherein said reinforcing material comprises at least one of resin or polymer applied to substantially all exterior surfaces of the folder.

* * * * *